United States Patent [19]

Nash

[11] 4,402,673

[45] Sep. 6, 1983

[54] DISPLAY HOLDER

[75] Inventor: Ronald J. Nash, Arlington, Va.

[73] Assignee: Veronica F. Nash, Arlington, Va.

[21] Appl. No.: 302,283

[22] Filed: Sep. 15, 1981

[51] Int. Cl.[3] ..... G09B 25/00

[52] U.S. Cl. ..... 434/365; 434/98

[58] Field of Search ..... 434/98, 365, 430; 206/1.7, 81; 40/152, 155, 158 R

[56] References Cited

U.S. PATENT DOCUMENTS

| | | | |
|---|---|---|---|
| 512,691 | 1/1894 | Ford | 206/81 X |
| 841,266 | 1/1907 | Northup | 206/81 X |
| 1,558,987 | 10/1925 | Kallscheur | 40/155 |
| 1,792,948 | 2/1931 | Weil | 40/155 |
| 2,414,183 | 1/1947 | Wolf | 40/152 |
| 2,442,967 | 6/1948 | Barasch | 40/155 |
| 3,382,595 | 5/1968 | Shore | 40/158 R |
| 3,798,798 | 3/1974 | Shore | 434/365 X |
| 3,803,729 | 4/1974 | Acerra | 434/365 |

*Primary Examiner*—Harland S. Skogquist

*Attorney, Agent, or Firm*—Craig B. Bailey

[57] ABSTRACT

A display holder to assist in the selection of mats and frames for a picture. The picture is placed on a flat mounting board. Mat corners are properly positioned at the corners of the picture by being received in step-like offsets formed in ledges extending along corners of the mounting board. Frame corners fit over the top of the ledges. Clamps secure the mat corners and picture in position. The mounting board is formed in two telescoping sections or in two sections slidably mounted on a base by dovetail connections to permit adjustment of the longitudinal dimension of the mounting board.

19 Claims, 8 Drawing Figures

FIG. 1
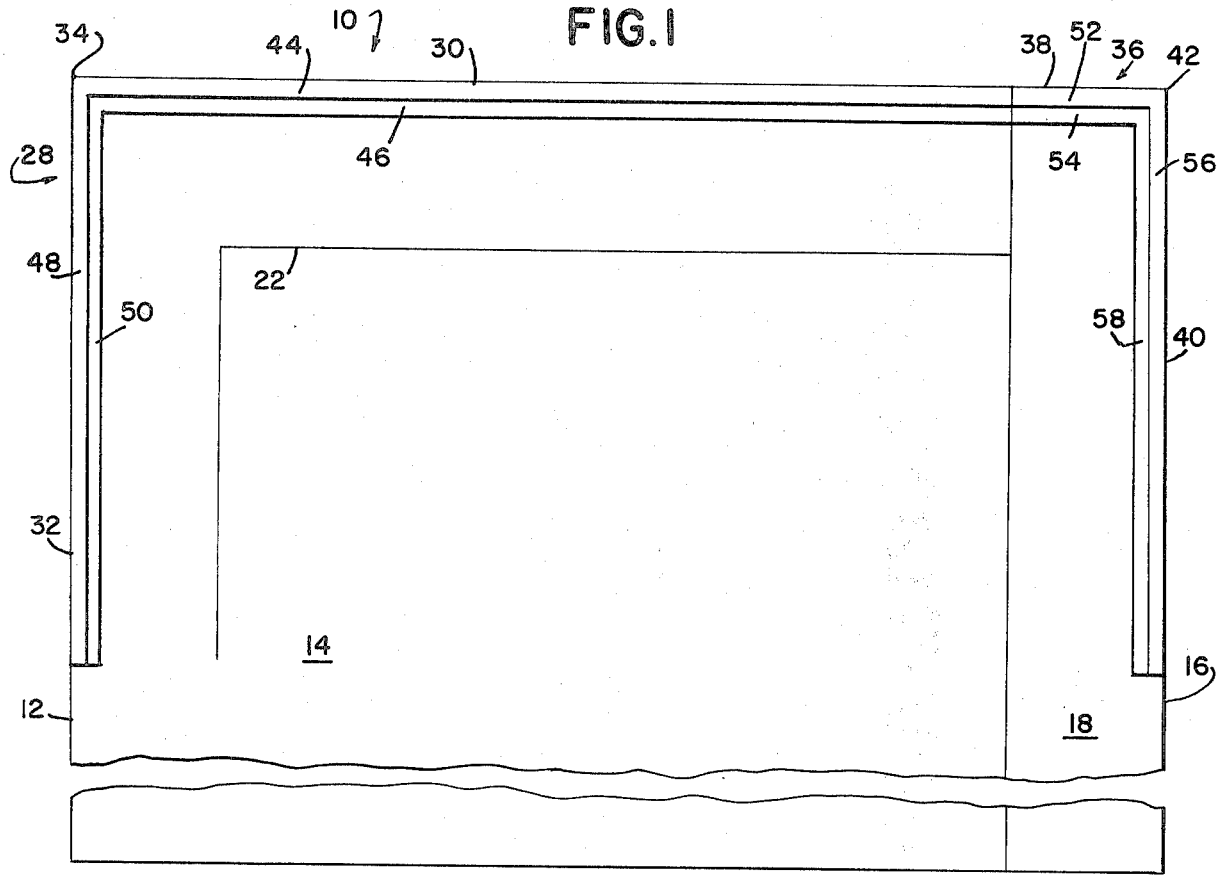
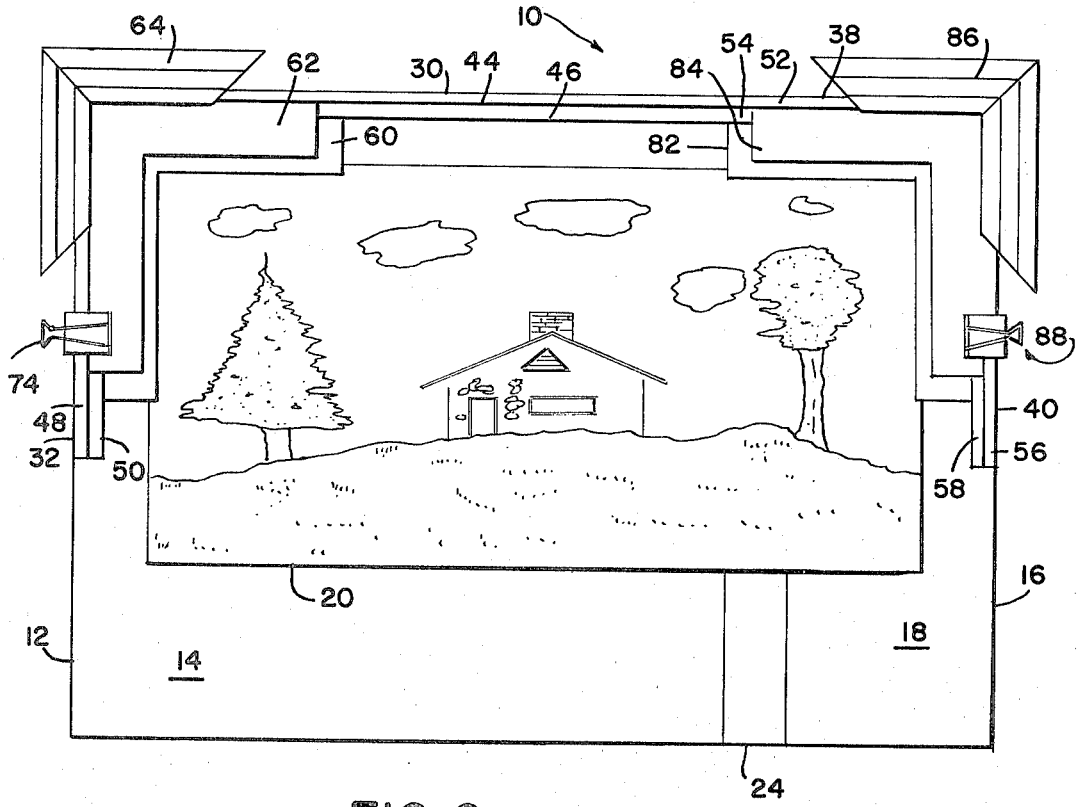
FIG. 2

DISPLAY HOLDER

BACKGROUND OF THE INVENTION

This invention relates generally to display holders and more particularly it has reference to a display holder designed to assist in the selection of mats and frames for a picture.

Pertinent United States and foreign patents are found in Class 35, subclasses, 16, 28, 40, 41, 53R and 63; Class 40, subclasses 10R, 124.1, 152, 155, 156, 159, 594 and 904; Class 206, subclass 44R; Class 209, subclass 546 and Class 428, subclasses 13 and 14 of the Offical Classifications of Patents in the U.S. Patent and Trademark Office.

Examples of pertinent patents are U.S. Pat. Nos.

U.S. Pat. No. 1,558,987
U.S. Pat. No. 1,792,948
U.S. Pat. No. 2,414,183
U.S. Pat. No. 2,534,961
U.S. Pat. No. 3,014,302
U.S. Pat. No. 3,382,595
U.S. Pat. No. 3,687,770
U.S. Pat. No. 3,798,798
U.S. Pat. No. 3,858,335
U.S. Pat. No. 3,873,342

U.S. Pat. No. 3,014,302 discloses an abstract device which uses a stepped edge frame. Transparent members are placed in the frame and supported at spaced intervals by steps. Randomly arranged elements are located in the spaces between the transparent members. The transparent members and elements are locked in place by a locking frame and locking members.

U.S. Pat. No. 3,687,770 discloses an apparatus for mounting pictures and mats. A grid coordinate system is used to correctly align and mount the picture and mat.

U.S. Pat. Nos. 1,558,987; 1,792,948 and 2,414,183 disclose adjustable frames and boards.

U.S. Pat. No. 1,558,987 shows a dovetail connection.

U.S. Pat. No. 3,382,595 discloses a mat which can be adjusted to accommodate pictures of various size. Adjustments are made by cutting and folding the inner border of the mat.

U.S. Pat. Nos. 3,798,798 and 3,858,335 disclose picture frame sections.

U.S. Pat. No. 2,534,961 discloses a printing mask which has a plurality of removable sections. Sections are removed to adjust the size of the opening in the mask.

U.S. Pat. No. 3,873,342 discloses a method for rendering a painting and providing a frame therefor.

No patent discloses a display holder for pictures, mats and frames.

One of the the most difficult aspects of custom picture framing is the selection of the proper frame. The natural beauty of a picture can be greatly enhanced when it is mounted in a well-coordinated frame. Conversely, a mismatched picture and frame can be quite unattractive. Frame selection is made more difficult by the fact that frames are available in a wide variety of sizes, shapes, colors and styles.

The custom framing procedure becomes even more difficult when it is desired to have one or mats or borders going around the picture between the picture and the frame. Mats are available in a wide variety of colors and styles and must be coordinated with each other and with the picture and the frame.

It can be extremely difficult to view the picture, mats and frames separately and to visualize the appearance of the finished product. It is essential that means be provided for quickly and easily arranging and displaying the picture, mats and frames in a form resembling a finished product.

Prior to the present invention, the means employed was the simple expedient of approximating the proper relative positions of the picture, mats and frames, hand-arranging those elements in their approximated positions, hand-grasping the arranged elements to fix them in arrangement, and lifting up the arrangement of elements by the corners to simulate a hanging picture. That means has proved unsatisfactory for a number of reasons. The proper positions of the mats and frames cannot be accurately determined without spending an undue amount of time making laborious measurements. Even if the proper positions were accurately determined, the elements would be easily displaced from those positions when the arrangement was gripped and held for display.

Another shortcoming with the prior art means for displaying mats and frames is its inability to provide side-by-side comparison of differing mat-frame combinations. Such a comparison can be very helpful in picking and choosing the most desirable mat-frame combination from a number of combinations under consideration. The prior art means could display only one mat-frame combination at a time.

Persons skilled in the art have long sought a more effective means for displaying pictures, mats and frames to aid in the selection of the most desirable picture-mat-frame combination.

SUMMARY OF THE INVENTION

The present invention overcomes many of the problems which exist in the prior art and satisfies the long-sought need for an effective means for displaying pictures, mats and frames.

The invention is a holder that allows a viewer to see how a picture will look with various mats and frames. Corners of the holder are provided with stepped ledges configured to receive mat corners and to properly position those corners with respect to a picture. The mats and picture are held in place by a clamp which extends over the ledges. Frame corners are rested on the ledges and the holder is lifted for display. Different frames can then be substituted.

In one embodiment, the holder is formed of two telescoping sections to permit adjustment of the longitudinal dimension of the holder for accommodating pictures of various size. In another embodiment, two top trays are connected to a bottom tray by dovetails, thereby allowing the top trays to slide longitudinally relative to the bottom tray, to accommodate pictures.

More specifically, the present invention is directed to a holder designed to assist in the selection of mats and frames for a picture. It enables a viewer to obtain an accurate impression of how the picture would look with different mats and frames.

The holder is designed to display a single mat, double or triple mat in various color and style combinations on the corners of the picture to be framed and to hold them securely. This allows the viewer to select the mat-frame combination that most complements the picture.

The holder keeps the mats displayed in the proper spacing around the picture, usually one eighth of an inch over the edge of the picture and each succeeding top mat one eighth of an inch from the edge of the preceding bottom mat. Clamps are attached to hold the mats in place. Frame corners are placed at the edges of the mats and the entire assembly is raised so that the viewer can see and compare and select the proper mat-frame combination.

The display holder can be made of plastic or plexiglass or wood or any other suitable material.

In one embodiment, the holder is a raised three-piece assembly wherein two top trays slide longitudinally back and forth on a base member. This permits adjustment of the longitudinal dimension of the holder so that it can accommodate pictures of various size. The two top trays are connected to the base member by a pair of dovetail connections. If desired, stops can be provided to limit the longitudinal movement of the trays and to prevent the disengagement of the dovetail connections.

In an alternative embodiment, the holder is formed of two telescoping sections to permit adjustment for picture size. The holder is supported in an elevated position by parallel lateral or longitudinal beams connected to the underside of the holder.

The present invention will be most helpful in selecting mats and frames for paintings because it permits the placing of one or more mats on the picture, placing the frame corner on the picture and securing the mats and picture in place, and then holding the assembly up at an angle, or vertical, so that it can be viewed to make a decision as to whether the mats and frames are right for the picture.

Different corners of the picture can be displayed with different mat-frame combinations. This facilitates the decision as to which mat-frame combination goes best with the picture. It also lets the viewer get a more exacting idea of how his picture will look when framed with his mat-frame selection.

The present invention can be used by a sales person in a frame store to show mat-frame combinations to a customer with ease and without mats and picture falling apart and slipping.

The method for using the display holder of the present invention is relatively straightforward.

The picture to be matted and framed is placed on the display holder at a designated area. For single mattings, a mat corner is placed at a corner of the display holder flush with the edge of a stepped ledge. For double matting, a second mat is placed on top of the first mat and arranged flush with the edge of the step formed in the ledge. The steps are designed so that the mats flush therewith will be properly spaced with respect to each other and with respect to the painting. In most applications, the first mat will overlap the edge of the painting by one eighth of an inch and the edge of the second mat will be spaced one eighth of an inch from the edge of the first mat to allow the first mat to show from beneath the top mat.

A clamp is applied to hold picture and mats in place and then the frame is placed over the ledge. The display holder is then raised with the picture and mat corners held in place and the frame resting on the ledge so that they can be viewed.

The display holder is adjustable to fit the size of the picture to be framed.

An object of the invention is, therefore, to provide an improved means of displaying pictures, mats and frames.

Another object of the invention is to provide a display holder which can display one or more mats and one or more mat-frame combinations simultaneously.

A further object of the invention is to provide a display holder which can be adjusted to accommodate pictures of various size.

A further object of the invention is to provide apparatus for displaying pictures, mats and frames comprising a mounting member having a relatively flat surface for receiving at least a corner of a picture, at least one ledge member connected to the flat surface of the mounting member, said ledge member having a pair of arm portions extending across said surface at right angles to each other, one or more step-like offsets being formed on the inward surfaces of said arm portions for matingly receiving outward edges of mat corners aligned with the corner of a picture received by the mounting member.

These and other and further objects and features of the invention are apparent in the disclosure which includes the above and below specification and claims and drawings.

BRIEF DESCRIPTION OF THE DRAWINGS

FIG. 1 is a top plan view of a display holder embodying features of the present invention.

FIG. 2 is a top plan view of the display holder shown in FIG. 1 in use.

DETAILED DESCRIPTION OF THE DRAWINGS

Figure 3:
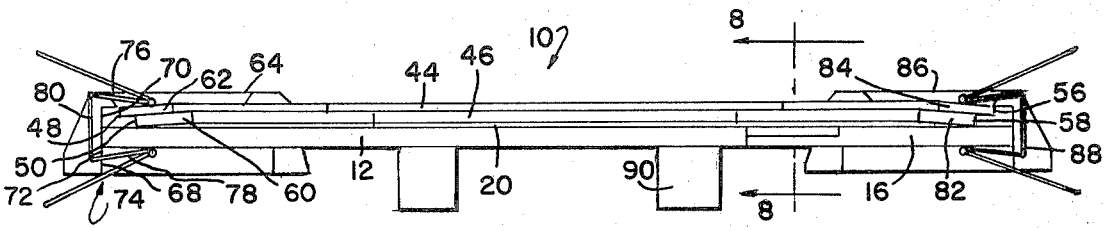
FIG. 3 is a front elevational view of the display holder shown in FIG. 2.
Figure 4:
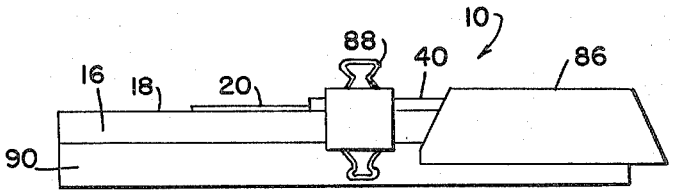
FIG. 4 is a side elevational view of the display holder shown in FIG. 2.

Referring to FIGS. 1–4, the display holder of the present invention is indicated generally by the numeral 10.

The display holder 10 has a generally rectangular board-like member 12 with a relatively flat upper surface 14. A second rectangular board-like member 16 has a relatively flat upper surface 18 which is coplanar with the flat upper surface 14 of the board-like member 12. The flat surfaces 14 and 18 provide a mounting and supporting surface for a picture 20.

Although the members 12 and 16 are shown in the figures to be board-like and to have a generally rectangular shape, the exact structure and configuration of the members 12 and 16 can be varied without departing from the present invention. The only limitation on those variations is the requirement that the members 12 and 16 provide a flat surface for mounting and supporting picture 20.

Referring to FIG. 1, it can be seen that a mark 22 is provided on the surface 14 of the member 12 in the vicinity of the upper left hand corner. The mark 22 consists of a pair of intersecting lines at right angles to each other. The mark 22 is spaced inwardly from the upper left hand corner of the member 12 but the vertex of the mark 22 is aligned with the vertex of the said upper left hand corner. In the preferred embodiment, the lines in the mark are spaced about $2\frac{5}{8}''$ from the adjacent edges of the member 12.

The mark 22 serves as a guide for proper positioning of the picture 20 on the surface 14 of the member 12. The upper left hand corner of the picture 20 is aligned with the mark 22 so that the edges of the picture extend along the lines of the mark 22.

It is understood that the exact appearance and location of the mark can be varied without departing from the present invention. The only limitation on these variations is that the mark be capable of properly positioning the picture 20 on the member 12.

Figure 8:
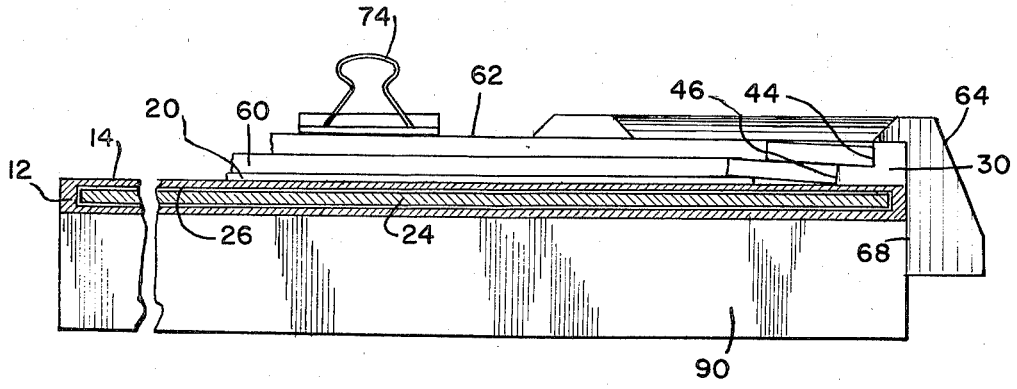
FIG. 8 is a sectional view taken long the line 8—8 shown in FIG. 3.

As best shown in FIGS. 2, 3 and 8, the member 16 has a longitudinal extension 24 of generally rectangular shape. Extension 24 is telescopically received within a rectangular opening 26 formed longitudinally through the member 12. The longitudinal dimension of the display holder 10 can thus be adjusted by longitudinally moving the member 16 relative to the member 12 and thereby telescoping the extension 24 within the opening 26.

Preferably, the extension 24 has a longitudinal dimension which is equal to the longitudinal dimension of the opening 26. Maximum longitudinal adjustment is possible when the opening 26 has a longitudinal dimension which is substantially equal to the longitudinal dimension of the member 12.

By longitudinally moving the member 16 relative to the member 12, the display holder 10 is adjusted to accommodate pictures of different dimensions. More specifically, the holder 10 should be adjusted so that the relative position between the upper right hand corner of the picture 20 and the upper right hand corner of the member 16 is identical to the relative position between the upper left hand corner of the picture 20 and the upper left hand corner of the member 12. For convenience, a mark (not shown) can be provided on the surface 18 of the member 16 to facilitate proper positioning of the upper right hand corner of the picture 20.

Preferably, the holder 10 has a longitudinal dimension of about 20" with the extension 24 fully retracted and a longitudinal dimension of about 34" with the extension 24 fully extended. The lateral dimension of the display holder is about 26". Such a display holder is capable of easily accommodating pictures ranging in size from 12"×16" to 20"×24". It is readily apparent, however, that those dimensions can be varied to accommodate pictures of different size without departing from the present invention.

Persons of ordinary skill in the art will readily recognize that the structure of the extension 24 and opening 26 can be varied from the specific structure shown in the figures without departing from the present invention. More specifically, it is apparent that the extension 24 and opening 26 can be replaced by any structure which is capable of connecting the members 12 and 16 and permitting relative longitudinal movement thereof.

If desired, stops (not shown) can be provided to limit the extent to which the extension 24 can be withdrawn from the opening 26. Stops can also be provided to prevent the extension 24 from being completely removed from the opening 26.

A stop mechanism which has proved particularly useful with the present invention uses an upwardly biased locking arm configured to engage a locking recess when maximum withdrawal is reached. More specifically, a first recess is provided on the upper surface of the longitudinal extension 24 remote from the member 16. The recess has a floor which slopes downwardly toward the member 16. A locking arm is mounted in the recess and connected to the extension 24 by a hinge connected to the end of the arm remote from the member 16. The hinge permits pivotal movement of the arm about an axis parallel to the lateral edges of the extension 24 and member 16. A coil spring spaced from the hinge has one end connected to the underside of the arm and the other end connected to the floor of the recess to bias the arm upwardly. A second recess is provided on the lower surface of the member 12 defining the upper boundary of the opening 26. The second recess is longitudinally aligned with the first recess and is positioned near the edge of the member 12 adjacent the member 16. The second recess has a roof which slopes upwardly toward the member 16. In use, the locking arm is held in the first recess by the lower surface. The member 12 and the extension 24 is the thus free to slide in-and-out of the opening 26. When the extension 24 nears full withdrawal, the first and second recess become vertically aligned and the spring urges the locking arm upwardly into the second recess. The edge of the arm remote from the hinge abuts the side of the second recess adjacent the member 16 to prevent further withdrawal of the extension 24. The sloping roof of the second recess guides the arm smoothly back into the first recess when the extension 24 is retracted.

A ledge member 28 is provided on the member 12. The ledge member 28 has an arm 30 extending across the upper longitudinal edge of the member 12 and an arm 32 extending part way along the outer lateral edge of the member 12. The arms 30 and 32 are at right angles to each other and intersect to form a corner 34. The outer edges of the arms 30 and 32 are flush with the adjacent outer edges of the member 12.

A similar ledge member 36 is provided on the board-like member 16. The ledge member 36 has an arm 38 extending across the upper longitudinal edge of the member 16 and an arm 40 extending partially along the outer lateral edge of the member 16. The arms 38 and 40 are at right angles to each other and intersect to form a corner 42. The outer edges of the arms 38 and 40 are flush with the adjacent outer edges of the member 16. The arm 38 is identical to the arm 30 in cross-section and is aligned therewith.

Preferably, the arms 30 and 38 provide a substantially continuous ledge along the upper longitudinal edge of the display holder 10 when the longitudinal extension 24 is fully retracted as shown in FIG. 1. However, one or both of the arms 30 and 38 can be shortened so that the ledge is made non-continuous.

In the preferred embodiment, the arms 32 and 40 have a length of about 10". That dimension makes the arms 32 and 40 slightly longer than the 9" legs of a standard mat corner sample used for displaying mats and frames. It can be readily appreciated, however, that the length of the arms 32 and 40 can be varied without departing from the present invention.

The inward surface of the ledge member 28 is provided with one or more step like offsets 44–58. As shown in the figures, the offsets are continuous along the arms 30, 32, 38 and 40 and are continuous around the corners 34 and 42. However, they need not be continuous. The present invention contemplates the use of non-continuous arm segments and non-continuous step like offsets. The only limitation is that the arms and offsets be positioned and aligned so that they are capable of properly positioning and aligning mat corners in the manner described below. Moreover, the present invention contemplates the use of any number of step like offsets. It will be understood from the discussion that follows that the number of offsets is directly related to the number of mat corners which can be displayed. A greater number of step like offsets permits the displaying of a greater number of mat corners.

The manner of displaying mat corners on the display holder 10 is best shown in FIGS. 2 and 3. The mat corners shown and described herein are the standard mat samples which are widely used by commercial framers.

After the picture 20 is properly mounted on the display holder 10, a first mat corner 60 is positioned so that the outer peripheral edges of the mat 16 abut the inner edges of the step like offsets 46 and 50. Because the corner 34 of the ledge member 10 is aligned with the vertex of the mark 22, the mat corner 16 will be properly aligned with the upper left hand corner of the picture 20.

A second mat corner 62 is positioned over the first mat corner 60 and the outer peripheral edges of the mat corner 62 are brought into abutment with the inner edges of the step like offsets 44 and 48. The mat corner 62 is thus aligned with the mat corner 60 but is slightly offset outwardly therefrom so that the inward portion of the mat corner is visible.

Preferably, the lines of mark 22 are spaced about $2\frac{5}{8}''$ from the inward edges of the step-like offsets 46 and 50 so that the standard $2\frac{3}{4}''$ wide mat corner will overlie the picture 20 by $\frac{1}{8}''$ when properly positioned on the display holder 10. Similarly, it is preferred that the step like offsets 46 and 50 have a width of $\frac{1}{8}''$ so that the second mat corner 62 will expose a $\frac{1}{8}''$ wide portion of the mat corner 60 when properly positioned on the display holder 10. It is readily understood, however, that those dimensions can be varied without departing from the present invention.

It is also preferred that the step like offsets have a height which is substantially equal to the thickness of the mat corners used therewith so that the upper surface of the mat corner is flush with the upper surface of the abutting step-like offset. This provides a smooth surface for supporting the superposing mat corner. It also provides a smooth surface along the top of the ledge member for supporting the frame corner in the manner described below.

The frame corners shown and described herein are the standard $7''\times 7''$ frame samples widely used by commercial framers. As shown in FIG. 3, the frame corner 64 has an inward surface of inverted L-shape.

After the mats 60 and 62 are properly mounted and held in place by clamp 74, the frame corner 64 is fitted over the ledge member 28 so that the short portion of the inward surface 68 abuts the upper surfaces of the step like offsets 44 and 48 and the long portion of the inward surface 68 abuts the outward surface 70 of the ledge member 28 and the outward surface 72 of the board-like member 12. The frame corner 64 is thus aligned with the mat corners 60 and 62 and with the upper left hand corner of the picture 20.

Preferably, the upper surfaces of the step-like offsets 44 and 48 are slightly narrower than the short portion of the inward surface 68 so that a small inward portion of the frame corner 64 overlies the mat corner 62. That arrangement is achieved by the use of the standard mat corner 64 and step-like offsets having a width of about $\frac{1}{8}''$. It is understood, however, that that arrangement is not essential and the dimensions of the inward surface 68 and the step-like offsets 44 and 48 can be varied without departing from the present invention.

As noted above, the outward surface 70 of the ledge member 28 is flush with the outward surface 72 of the board member 12. Consequently, those outward surfaces 70 and 72 abuttingly mate with the long portion of the inward surface 68. The short portion of the inward surface 68 abuttingly mates with the upper surface of the ledge member 28. It is thus understood that the frame corner 64 can be mounted on the display holder 10 even in the absence of the mats 60 and 62.

As a corollary, it is understood that the frame corner 64 can be eliminated where it is desired to display only the mats.

The mats 60 and 62 and picture 20 are held in position by a clamp 74. The clamp 74 is of conventional design, having upper arm 76 and lower arm 78 resiliently urged together by a spring element 80. The clamp 74 is fitted over the display holder 10 so that the upper arm 76 extends over the arm 32 of the ledge member 28 and bears against the upper surface of the mat corner 62 and the lower arm 78 extends over the arm 32 of the ledge member 28 and abuts the lower surface of the board member 12. The spring element 80 urges the arms 76 and 78 toward each other and thus presses the mats and picture to the board member 12. In an alternative embodiment, the mats and frames are both held by the clamp. The arms of the clamp extend over the frame corner and bear against the upper surface of the top mat corner and the lower surface of the board member to press the mats and frames to the board member 12.

If desired, additional mats 82 and 84 and an additional frame 86 can be mounted on the display holder 10 adjacent the upper right hand corner of the picture 20. The structure and function of the ledge member 36 is identical to the structure and function of the ledge member 28 and the procedure for mounting the mats 82 and 84 and frame 86 is identical to the procedure for mounting the mats 60 and 62 and frame 64. A clamp 88 which is identical to the clamp 84 holds the mats 82 and 84 and picture 20 in position.

Although the display holder 10 is provided with ledge members at only the upper corners, it is readily apparent that similar ledge members could be applied to the lower corners for supporting similar mats and frames.

The provision of means for displaying mats and frames on more than one corner of the picture allows the viewer to make a side-by-side comparison of different mat-frame combinations. For example, it is anticipated that the mats 60 and 62 and frame 64 would differ from the mats 82 and 84 and frame 86 shown in FIG. 2.

On the other hand, the mat-frame combination 60–64 could be made identical to the mat-frame combination 82–86 so that the display could more closely resemble the appearance of a finished product using that mat-frame combination.

In the preferred embodiment, the clamps 74 and 88 are positioned about 8" from the upper longitudinal edge of the display holder 10. It is understood, however, that that dimension can be varied without departing from the present invention. In addition, it is understood that the clamps 74 and 88 can be permanently connected to their respective members 12 and 16 or they can be detachable therefrom as desired. The preferred means of permanently connecting the clamps 74 and 88 to the members 12 and 16 is to permanently attach the ends of the lower arms of the clamps 74 and 88 to the undersides of the members 12 and 16.

The member 12 is supported and elevated by a pair of beamlike feet 90 which extend laterally across the underside of the member 12. The feet should be sufficiently high to elevate the lower arms of the clamps 74 and 88 and to elevate the lower ends of the frames 64 and 86. Preferably, the feet 90 have a height of about 2".

In an alternative embodiment, the feet are arranged to extend longitudinally across the underside of the member 12. The ends of the feet are spaced inwardly from the outer lateral edge of the member 12 to accommodate the portion of the frame corner 64 extending inwardly beneath the member 12. Preferably, the ends of the feet are spaced inward from the lateral edges of the member 12 about 1" and spaced inward from the longitudinal edges of the member 12 about 3". Those dimensions can be varied without departing from the present invention.

It is understood that similar legs can also be provided on the underside of the member 16 if desired.

Use of the present invention can now be readily understood.

The framer examines available mat and frame samples and selects the mat-frame combinations which seem appealing. He then mounts those mats and frames on the display holder 10 over the picture 20 edge, mounting more than one combination at a time, if desired. After the mats are clamped in position and the frame corners set on the ledges, the display holder 10 is raised and aligned with a vertical plane to simulate the appearance of a hinging picture. The appearance of the various mat-frame combinations in the finished product can thus be readily visualized without the mats and picture slipping out of place.

The procedure is repeated with different mat-frame combinations until the most suitable combination is determined.

It has been found that 1½" to 2" wide flat plastic clamps are sufficient to secure any of the various mat styles and configurations which would normally be encountered.

Figure 5:
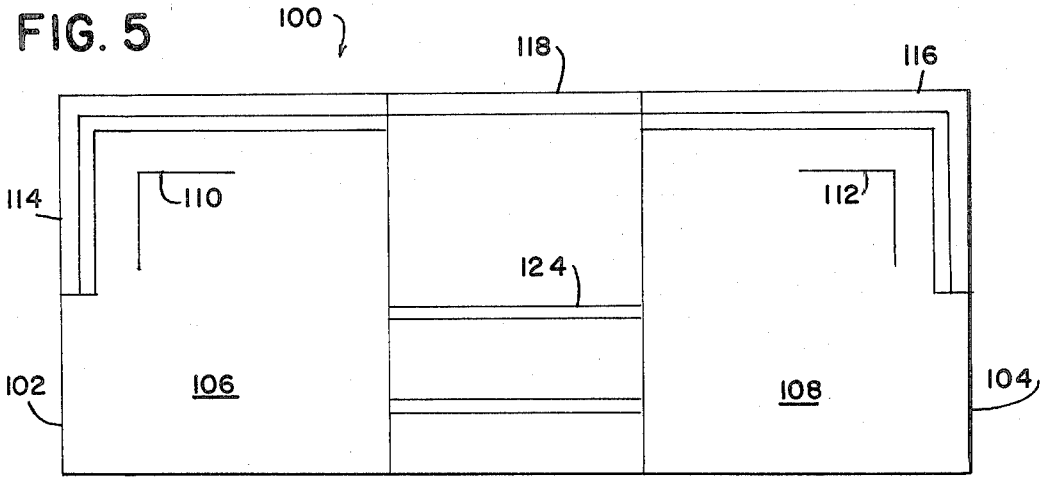
FIG. 5 is a top plan view of another display holder embodying features of the present invention.
Figure 6:
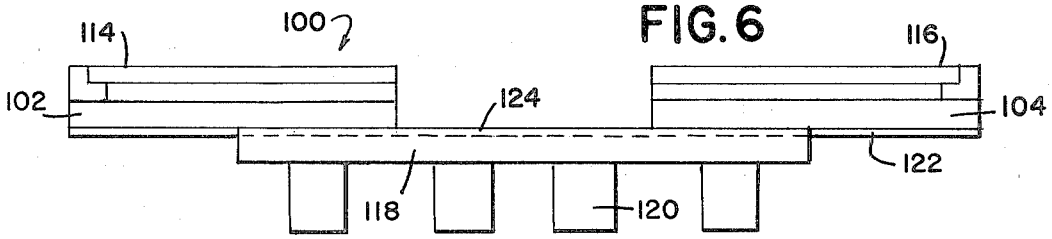
FIG. 6 is a front elevational view of the display holder shown in FIG. 5.
Figure 7:
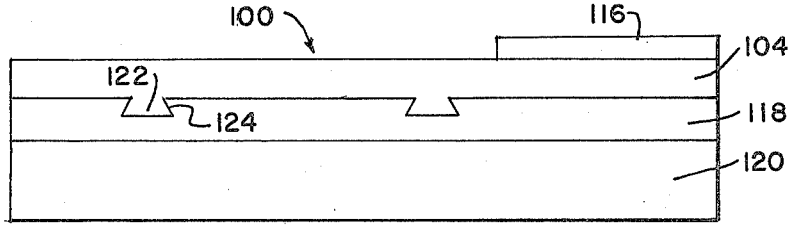
FIG. 7 is a side elevational view of the display holder shown in FIG. 5.

Another embodiment of the present invention is shown in FIGS. 5–7. The display holder of that embodiment is indicated generally by the numeral 100.

The primary difference between display holder 100 and the display holder 10 is the structure of the means for permitting relative longitudinal movement of the board like members.

The display holder 100 has a pair of boardlike members 102 and 104. The members 102 and 104 have substantially coplanar flat upper surfaces 106 and 108 respectively. The members 102 and 104 shown in the figures have substantially identical rectangular shapes but it is understood that the sizes and shapes of the members 102 and 104 can be varied without departing from the present invention.

The upper surfaces 106 and 108 of the members 102 and 104 are provided with marks 110 and 112 respectively which are structurally and functionally similar to the mark 22 shown in FIG. 1.

The members 102 and 104 are also provided with ledge members 114 and 116. The ledge members 114 and 116 are structurally and functionally similar to the corresponding ledge members 28 and 36 shown in FIG. 1.

A board-like support member 118 is positioned under the members 102 and 104 so that the upper surface of the member 118 abuts the lower surfaces of the members 102 and 104. The support member 118 preferably has a lateral dimension which is substantially equal to the lateral dimensions of the members 102 and 104 and a longitudinal dimension which is substantially equal to the combined longitudinal dimensions of the members 102 and 104. However, it is apparent that the size and shape of the support member 118 can be varied without departing from the present invention.

The support member 118 is supported and elevated by a set of beam-like feet 120 which extend laterally across the underside of the support member 118. The feet 120 are substantially identical to the feet 90 shown in FIG. 3. Like the feet 90, the feet 120 must have a height which is sufficient to elevate the frames and clamps applied to the display holder 100. Alternatively, the feet can be arranged to extend longitudinally across the underside of the support member 118 in a manner similar to the longitudinal feet used with the member 12.

The upper surface of the support member 118 is provided with longitudinally extending dovetail mortises 124 which are configured to slidingly receive corresponding dovetail tenons 122 formed on the undersides of the members 102 and 104. The dovetails serve the dual purpose of attaching the members 102 and 104 to the support member 118 and of permitting relative longitudinal movement of the members 102 and 104. It will be understood that the members 102 and 104 are moved longitudinally by sliding the tenons 122 back and forth within the mortises 124. Relative longitudinal movement of the members 102 and 104 varies the longitudinal dimension of the display holder 100 so that the display holder 100 can accommodate pictures of differing size.

In an alternative embodiment, telescoping aluminum tubes are used in place of the dovetail mortises 124 and tenons 122. Longitudinally extending tubes are connected to the undersides of the members 102 and 104. Corresponding longitudinal tubes of slightly larger diameter are embedded in the upper surface of the support member 118 and are provided with longitudinal slots extends along their upper portions. The tubes connected to the members 102 and 104 telescope within the tubes connected to the member 118 to permit relative longitudinal movement of the members 102 and 104.

If desired, stop means can be provided to limit the relative longitudinal movement of the members 102 and 104. In the preferred embodiment, the members 102 and 104 have a longitudinal dimension of about 11" and stops are provided to limit the outward longitudinal movement of the members 102 and 104 to about 8". It is understood, however, that those specifications can be varied without departing from the present invention.

In a modified version of the embodiment shown in FIGS. 5–7, the support member 118 consists of a pair of side-by-side board-like members, the members 102 and 108 are formed integrally as a single board-like member having lateral and longitudinal dimensions which are less than the lateral and longitudinal dimensions of the support member, and the ledge members 114 and 116 are connected to the upper surface of the support member. The picture to be framed is mounted on the integral board member and the pair of support members are moved longitudinally with respect to each other to properly position the ledge members with respect to the corners of the picture.

While the invention has been described with reference to a specific embodiment, the exact nature and scope of the invention is defined in the following claims.

I claim:

1. Apparatus for displaying pictures, mats and frames comprising a mounting member having a relatively flat surface for receiving at least a corner of a picture, and at least one ledge member connected to the flat surface of the mounting member, said ledge member having a pair of arm portions extending across said surface at right angles to each other, one or more step-like offsets being formed on the inward surfaces of said arm portions for matingly receiving the outward edges of mat corners aligned with the corner of the picture received by the mounting member.

2. The apparatus of claim 1 wherein the arm portions intersect to define an inwardly facing corner on said flat surface for matingly receiving the outward edges of a first mat corner, and the step-like offsets extend around the corner to define one or more additional inwardly facing corners spaced above and offset outwardly with respect to the corner on the flat surface and having vertices coplanar therewith for matingly receiving the outward edges of a corresponding number of additional overlapping mat corners aligned with the first mat corner and the corner of the picture.

3. The apparatus of claim 1 wherein the ledge member is positioned to define a peripheral boundary of the flat surface.

4. The apparatus of claim 1 wherein the ledge member is positioned along the outer peripheral edge of the mounting board to define a generally inverted L-shaped outward surface for mating with a correspondingly shaped inward surface of a frame corner aligned with the mat corners.

5. The apparatus of claim 1 wherein the ledge member has a third arm portion extending across said surface at right angles to one of the pair of arm portions and facing the other of the pair of arm portions, one or more step-like offsets being formed on the inward surface of the third arm portion for matingly receiving outward edges of mat corners aligned with an adjacent corner of the picture, said third arm portion and said other of the pair of arm portions being sufficiently spaced to accommodate therebetween adjacent corners of the picture received on the mounting member.

6. The apparatus of claim 1 wherein the flat surface is marked with a pair of lines at right angles to each other and parallel to and spaced inwardly from said pair of arm portions, the edges of the picture defining said picture corner being positioned along the lines.

7. The apparatus of claim 1 wherein the mounting member comprises a board-like planar member having upper and lower surfaces, said flat surface being formed on the upper surface and support means being connected to the lower surface.

8. The apparatus of claim 7, wherein the support means comprises a pair of spaced parallel beams extending laterally across said lower surface.

9. The apparatus of claim 1 wherein the mounting member comprises a pair of planar members displaceable longitudinally with respect to each other.

10. The apparatus of claim 9 wherein the planar members are telescoped together.

11. The apparatus of claim 1 wherein the mounting member comprises a first planar member having a central opening formed longitudinally therein and having a surface portion providing a portion of said flat surface, and a second planar member having a longitudinally extending portion adapted to telescope within said central opening and having a surface portion coplanar with the surface portion of the first planar member providing a further portion of said flat surface.

12. The apparatus of claim 11 wherein the first planar member comprises a generally rectangular board having a central opening of generally rectangular cross-section and of longitudinal dimension slightly less than that of the rectangular board, and the second planar member comprises a first generally rectangular board having a longitudinal dimension equal to the longitudinal dimension of the central opening and adapted to telescope therein and a second generally rectangular board connected to the first generally rectangular board along the lateral edge thereof, said second board having a relatively flat surface coplanar with a relatively flat surface of the rectangular board of the first planar member.

13. The apparatus of claim 9 wherein a first one of said ledge members is positioned along a peripheral corner of one of said pair of planar members and a second one of said ledge members is positioned along a peripheral corner of the other of said pair of planar members, said peripheral corners being longitudinally adjacent to each other and having collinear longitudinal edges and parallel lateral edges.

14. The apparatus of claim 1 wherein clamp means are provided on the mounting member in the vicinity of said ledge members for clamping said mat corners to the ledge members.

15. The apparatus of claim 4 wherein a clamp having upper and lower arms resiliently urged together by spring means is provided on said peripheral edge of the mounting member positioned along the ledge member, the lower arm being adapted to contact a lower surface of the mounting member and the upper arm being adapted to contact an upper surface of said mat corners received by the ledge member to clamp said mat corners to the ledge member.

16. The apparatus of claim 1 wherein the mounting member and the ledge member are formed of plastic material.

17. The apparatus of claim 1 wherein the mounting member and the ledge member are formed integrally.

18. The apparatus of claim 1 wherein the mounting member comprises first and second coplanar planar members having upper surfaces defining said flat surface and having lower surfaces provided with connecting means, and a base member having an upper surface positioned adjacent the lower surfaces of the planar members and being provided with connecting means for cooperating with the connecting means on the planar members for slidably connecting the planar members to the base member to permit relative longitudinal movement of the planar members.

19. The apparatus of claim 18 wherein the connecting means on the planar members comprise longitudinally extending dovetail tenons and the connecting means on the base member comprises a longitudinally extending dovetail mortise.

* * * * *